US006050319A

United States Patent [19]

Hinton

[11] Patent Number: 6,050,319

[45] Date of Patent: Apr. 18, 2000

[54] NON-ROUND CONTAINER LABELING MACHINE AND METHOD

[75] Inventor: Gaylen R. Hinton, Turlock, Calif.

[73] Assignee: Trine Labelling Systems, Turlock, Calif.

[21] Appl. No.: 09/143,200

[22] Filed: Aug. 31, 1998

[51] Int. Cl.[7] ..... B65C 9/00; B65C 9/02; B65C 9/04

[52] U.S. Cl. ..... 156/556; 156/566; 156/567; 156/446; 156/449; 156/DIG. 25; 156/DIG. 26

[58] Field of Search ..... 156/556, 566, 156/567, DIG. 13, DIG. 11, DIG. 25, DIG. 26, 456, 446, 449

[56] References Cited

U.S. PATENT DOCUMENTS

| | | | |
|---|---|---|---|
| 4,181,555 | 1/1980 | Hoffman | 156/265 |
| 4,566,933 | 1/1986 | Crankshaw et al. | 156/444 |
| 4,798,648 | 1/1989 | Freeman | 156/542 |
| 5,785,803 | 7/1998 | Schiessl | 156/358 |
| 5,964,974 | 10/1999 | Hinton | 156/215 |

*Primary Examiner*—Richard Crispino
*Assistant Examiner*—Sue A. Purvis
*Attorney, Agent, or Firm*—Trial & Technology Law Group

[57] ABSTRACT

The present invention provides a non-round container labeling machine and corresponding method. In one embodiment, the present invention provides a labeling machine for applying a label to a non-round container or article where the non-round article has a series of corners located about its surface. The labeling machine according to the present invention includes a rotatable vacuum drum, the drum including engaging means for rotatably engaging the corners of the non-round articles. The labeling machine includes a label associated with the engaging means and a resilient roll on pad means. The labeling machine further includes means for rotating the non-round article between the drum and roll on pad means wherein the engaging means engages a first corner to rotate the article between the drum and the pad means such that the drum generates a torque which rotates the article as the drum rotates and which compresses the roll on pad means such that the pad means stores compressed torque energy. As the article rotates to a position where the first corner is disengaged from the engaging means and a non-corner flat or face portion of the article is against the drum, the roll on pad means imparts or releases the stored energy near or on a second corner of the article which further rotates the article until the engaging mean engages the second corner of the article to continue rotation of the article between the drum and pad means and wherein the label is applied to the surface of the non-round article.

4 Claims, 7 Drawing Sheets

NON-ROUND CONTAINER LABELING MACHINE AND METHOD

BACKGROUND OF THE INVENTION

The present invention relates to a non-round container or article labeling machine and corresponding method. Labeling non-round articles in the past with wrap-around labels has been limited to turret-type labeling machines. This is because a turret-type machine has been the only method for consistently rotating an article as a label is being wrapped around it. Although attempts have been made to label non-round containers using very soft roll-on-pads in a compression roll-through labeling machine, none of these attempts have produced a commercially viable product. The reason for this is that even though a soft roll-on-pad can absorb the irregular surface of the container, the compression roll-through process fails to provide the torque necessary to consistently rotate the container throughout the entire labeling operation.

A compression roll-through labeling machine provides torque to rotate the article being labeled by friction of the rotating vacuum drum rolling the article against a stationary roll-on-pad. This friction is not just the friction of the vacuum drum against the article, but the friction of the vacuum drum against the label and the label against the article. With round articles, the required torque to induce rotation is constant throughout the labeling process, and this torque is easily obtained by pressing the container against the vacuum drum with the compression of the roll-on-pad. However, with non-round articles, the torque required for rotation varies greatly during the labeling process.

With a non-round article in a standard compression roll-through machine, the greatest amount of torque is required to rotate the article when a flat side is toward the vacuum drum. This is because of two reasons. The first is because a flat side causes the least amount of compression on the roll-on-pad, and any attempt to rotate the article from the flat side results in greater compression, hence greater required torque. The second reason is that as a non-round article rotates from a flat side to a corner, the center of mass has to quickly change its direction of movement, resulting in an inertial load that gets worse with speed.

The need for additional rotational torque is greatly compounded by the fact that the greatest torque is needed is when a compression roll-through machine delivers the least. This is due to the fact that the roll-on-pad pressure is minimal when the flat of an article is against the vacuum drum. Any attempt to increase the roll-on-pad pressure to give more torque also increases the required torque, and so stable rotation can never be achieved. Only articles with high coefficients of friction (to increase the torque) and almost-round profiles can be labeled with any degree of success in a standard compression roll-through labeling machine.

In view of the foregoing, it would be desirable to provide an improved labeling machine and corresponding method for applying labels to non-round containers or articles.

SUMMARY OF THE INVENTION

It is an object of the present invention to provide a non-round container labeling machine and corresponding method.

In one embodiment, the present invention provides a labeling machine for applying a label to a non-round container or article where the non-round article has a series of corners located about its surface. The labeling machine according to the present invention includes a rotatable vacuum drum, the drum including engaging means for rotatably engaging the corners of the non-round articles. The labeling machine includes a label associated with the engaging means and a resilient roll on pad means. The labeling machine further includes means for rotating the non-round article between the drum and roll on pad means wherein the engaging means engages a first corner to rotate the article between the drum and the pad means such that the drum generates a torque which rotates the article as the drum rotates and which compresses the roll on pad means such that the pad means stores compressed torque energy. As the article rotates to a position where the first corner is disengaged from the engaging means and a non-corner flat or face portion of the article is against the drum, the roll on pad means imparts or releases the stored energy near or on a second corner of the article which further rotates the article until the engaging mean engages the second corner of the article to continue rotation of the article between the drum and pad means and wherein the label is applied to the surface of the non-round article.

Other objects, features and advantages of the present invention will become apparent from the following detailed description when taken in conjunction with the accompanying drawings.

BRIEF DESCRIPTION OF THE DRAWINGS

The accompanying drawings, which arc incorporated in and form a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to those embodiments. On the contrary, the invention is intended to cover alternatives, modifications and equivalents, which may be included within the spirit and scope of the invention as defined by the appended claims.

Figure 1:
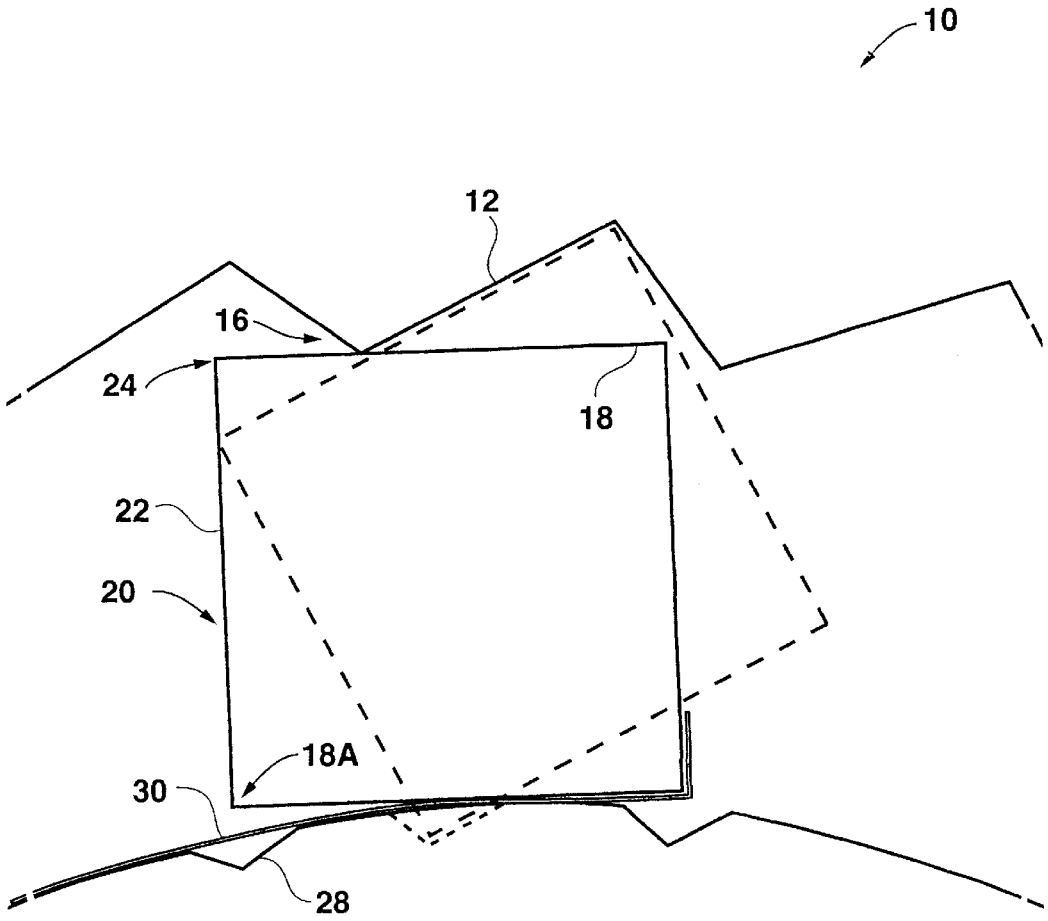
FIG. 1 shows a block diagram of a non-round container labeling machine according to the present invention.

Referring now to the drawings, FIG. 1 shows a block diagram of a non-round container labeling machine 10 according to the present invention. The present invention solves the problems described above by storing energy during the time when the torque is the greatest but needed the least. This energy is then imparted to rotating the container or article during the time that it needs the most torque.

In FIG. 1, he energy is stored by compressing a resilient peak 16 in the roll-on-pad 12 while the vacuum drum 14 is driving the corner 18 of the non-round article, and then this compressed peak forces the article 20 to rotate when its flat portion 22 is against the vacuum drum 14. This compressed peak 16 pushes against one corner 24 of the article 20, and the other corner 18 is free to rotate without any compressive resistance, as shown in FIG. 1.

As described above, FIG. 1 shows a square article 20 on a vacuum drum 14 with a compressed peak 16 of the sawtooth profile of the roll-on-pad 12 pressing against the article 20 near one corner 24 as shown by the arrow. As the vacuum drum 14 rotates in the direction of its arrow shown in FIG. 1, the pressure on the corner 24 of the article 20 causes it to rotate into the position shown by the dotted lines. At this position a corner 18A of the article 20 has engaged a notch 28 on the vacuum drum 14, and there is significant torque rotating the article 20 as the vacuum drum 14 continues to rotate. This positive torque then compresses the next sawtooth peak 16 as the vacuum drum 14 continues to rotate the article 20. As the article 20 then rotates to the position where the corner 18A of the article 20 is disengaged from the vacuum drum 14, the resilient sawtooth peak 16 has been sufficiently compressed and its force will aid the article 20 in continuing to rotate until the next corner 24 engages a respective notch 28 on the vacuum drum 14.

The notch 28 on the vacuum drum 14 also aids in assuring that the label 30 is tightly applied to the article 20. As the label 30 is over the notch 28, as shown in FIG. 1, when the corner 18 of the article 20 engages that notch 28, the corner 28 will tend to stretch the label 30 tight. This can also compensate for any slippage that might occur as the article 20 rotates.

Although the notch 28 in the vacuum drum 14 is extremely important for very angular articles, for articles with rounded corners, it may not be necessary. The effect of the sawtooth profile 16 alone can keep such an article rotating smoothly by getting it past the flat spots.

Figure 2:
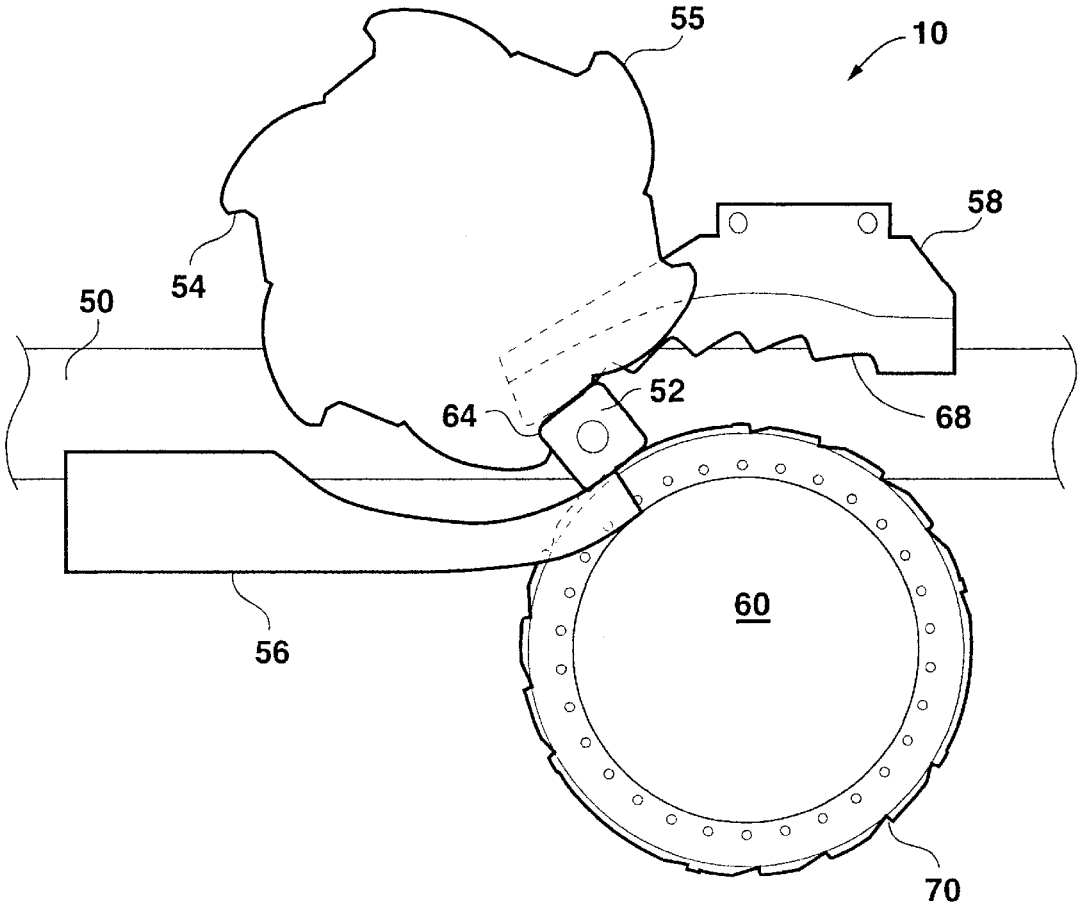
FIG. 2 shows a top view of the labeling machine of FIG. 1.

FIG. 2 shows a top view of the labeling machine 10 of FIG. 1. In FIG. 2, a conveyor 50 is a continuous moving belt that transports a series of non-round (e.g., square) articles or containers 52. The infeed guide 56 in conjunction with starwheel 55 provides for guiding a series of non-round containers 52 between roll-on pad 58 and vacuum drum 60. As seen in FIG. 2, starwheel 58 has a series of teeth or notches 54 which rotationally engage a corner 64 on container 52. The roll-on-pad 58 of FIG. 2 typically has an aluminum backing and has a resilient foam coating in the form of corresponding notches or teeth 68. As can be seen in FIG. 2, a container 52 is rotated between roll-on-pad 58 and vacuum drum 60 in a manner analogous to the machine as described above in conjunction with FIG. 1.

Figure 3:
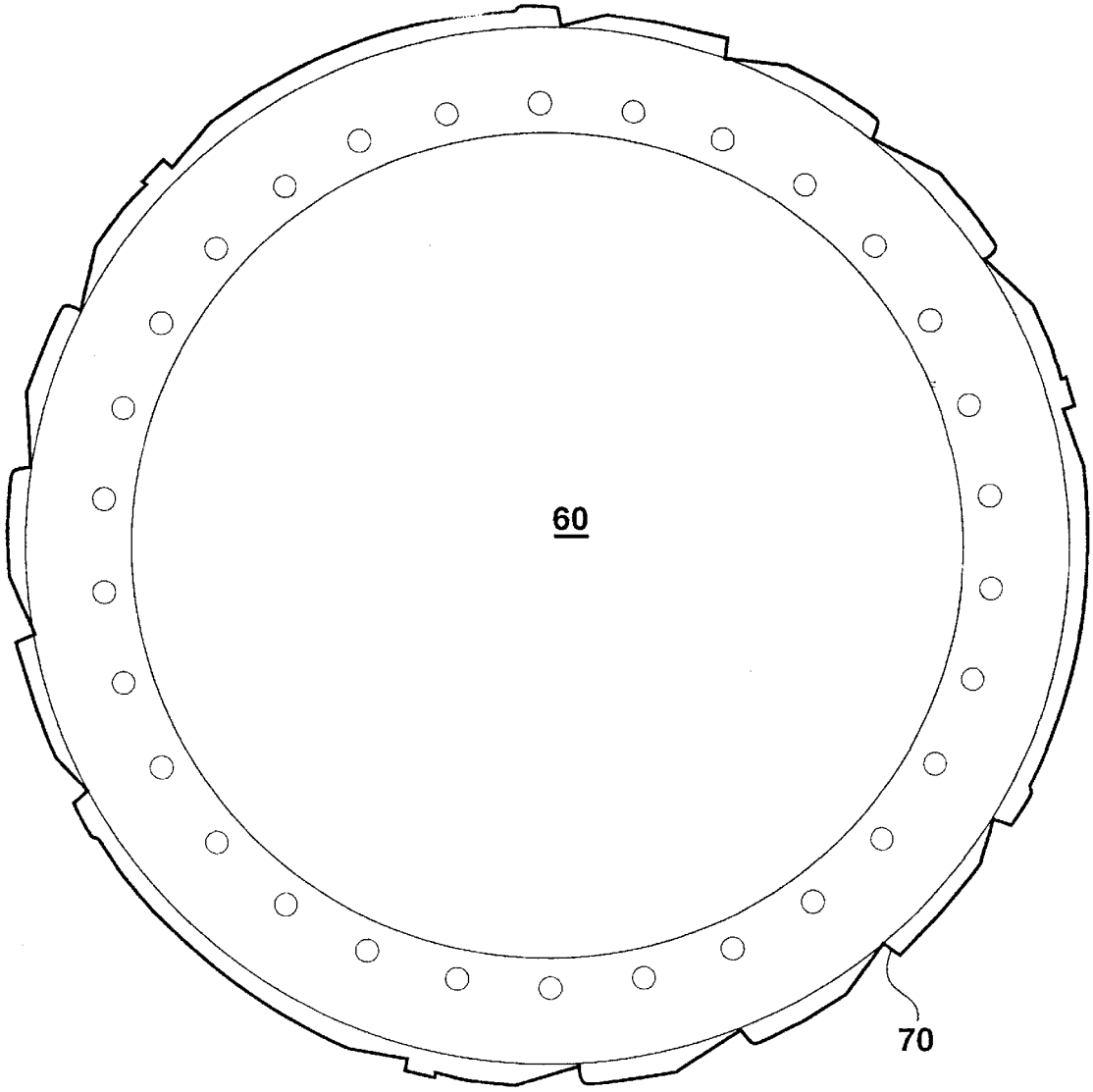
FIG. 3 shows a cross sectional view of the vacuum drum which forms a portion of FIG. 2.

FIG. 3 shows a cross sectional view of the vacuum drum which forms a portion of FIG. 2. As can be seen in FIG. 3, the vacuum drum 60 includes a series of notches 70 which function to engage a respective corner 64 of a non-round container 52, as described in FIG. 2.

FIGS. 4A–4D show top views of the labeling machine of FIG. 1 which illustrates a cycle of operation according to the present invention. Although a single container or article 52 is shown in FIGS. 4A–4D, it should be understood that the features of the present invention will apply to a series or plurality of containers being conveyed into the labeling machine 10 of the present invention. The description of the rotation of a single container 52 is for clarity purposes.

Figure 4A:
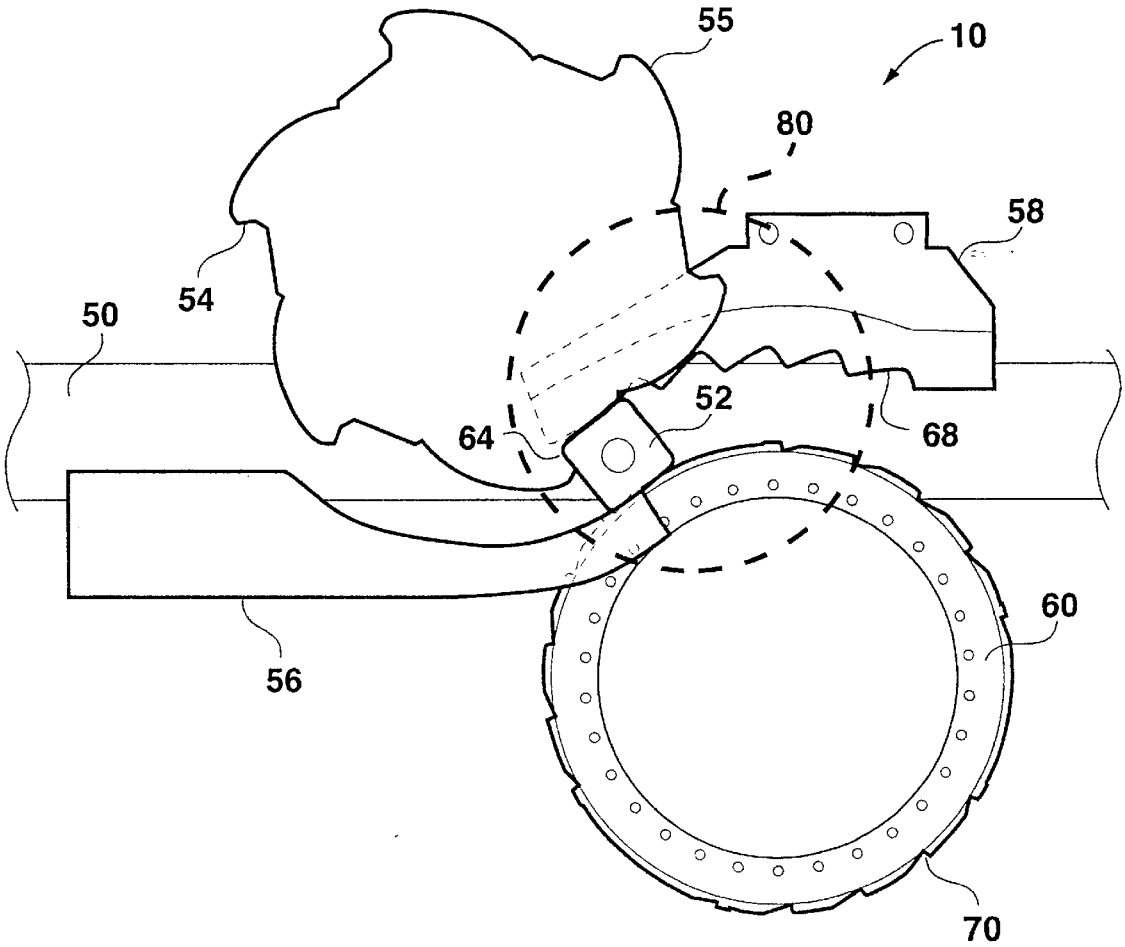
FIGS. 4A–4D show top views of the labeling machine of FIG. 1 which illustrates a cycle of operation according to the present invention.

FIG. 4A shows a similar view as for FIG. 2. In FIG. 4A, a conveyor 50 is a continuous moving belt that transports a series of non-round (e.g., square) articles or containers 52. Infeed guide 56 in conjunction with starwheel 55 provides for guiding a series of non-round containers 52 between roll-on pad 58 and vacuum drum 60. As seen in FIG. 4A, starwheel 58 has a series of teeth or notches 54 which rotationally engage a corner 64 on container 52. The roll-on-pad 58 of FIG. 4A has a resilient foam coating in the form of corresponding notches or teeth 68. As can be seen in FIG. 4A, a container 52 is rotated between roll-on-pad 58 and vacuum drum 60 in a manner analogous to the machine as described above in conjunction with FIG. 1. The circle portion 80 shown in FIG. 4A will now be described in more detail in conjunction with FIGS. 4B–4D.

Figure 4B:
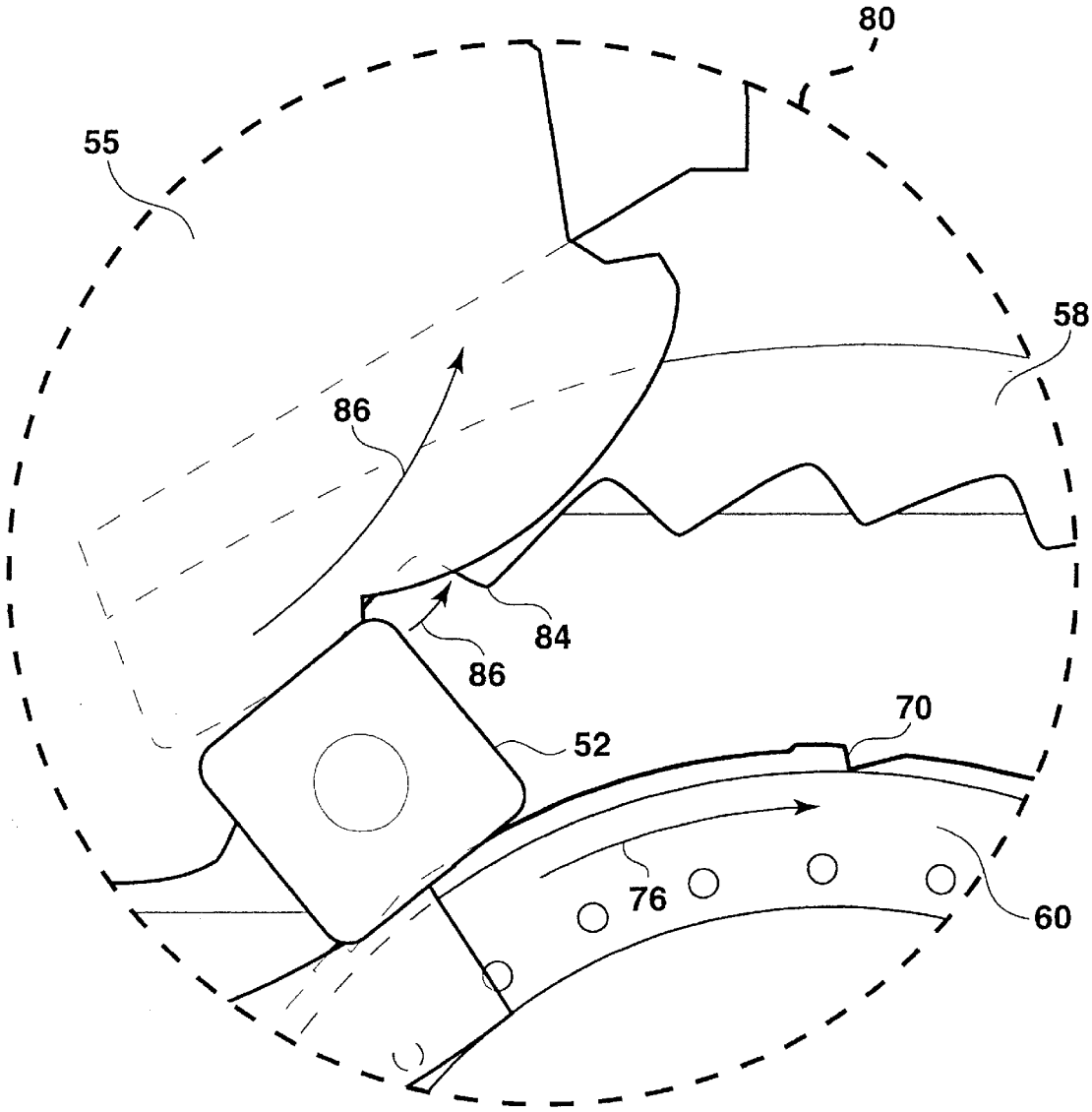
Figure 4C:
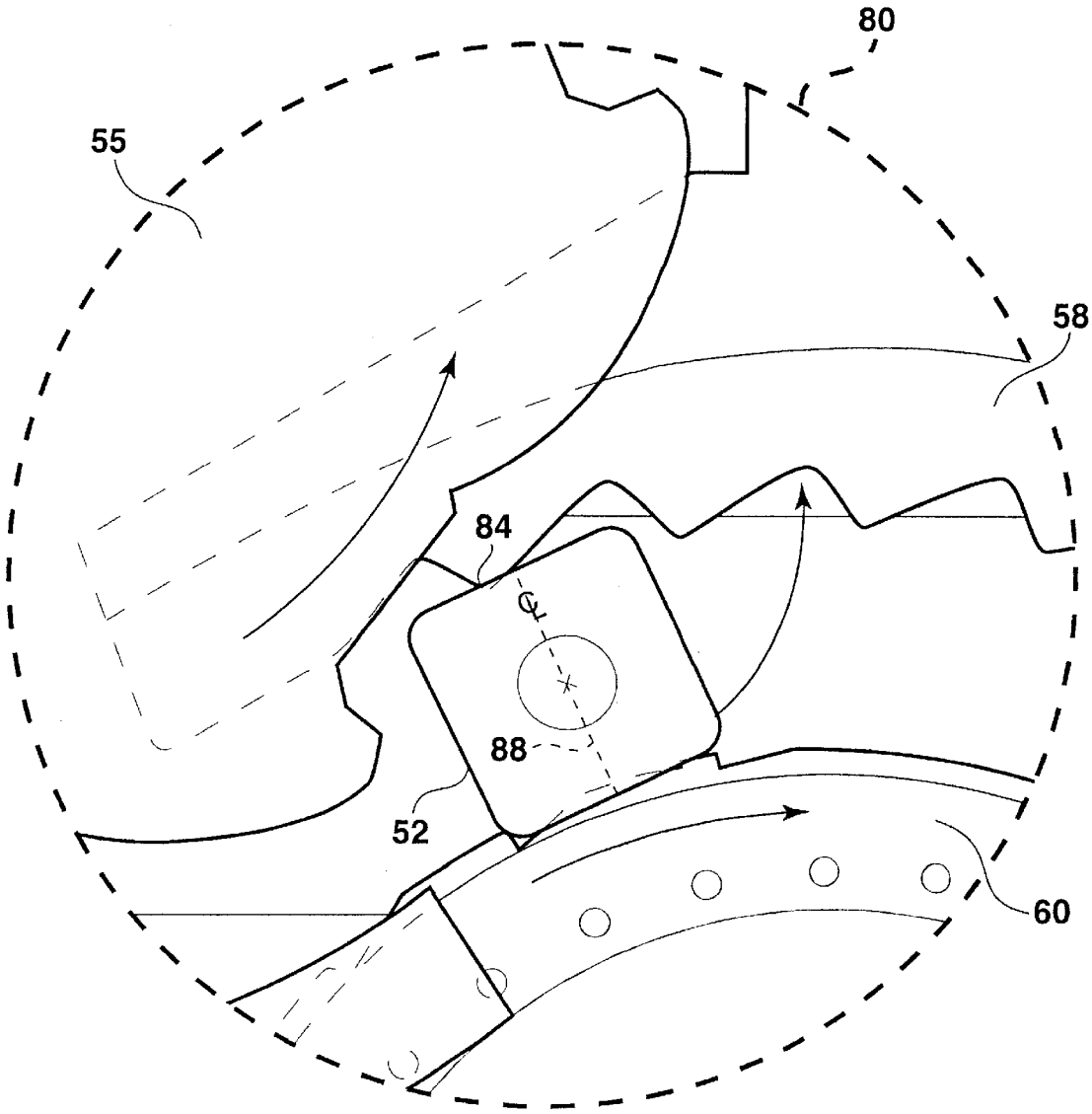
Figure 4D:
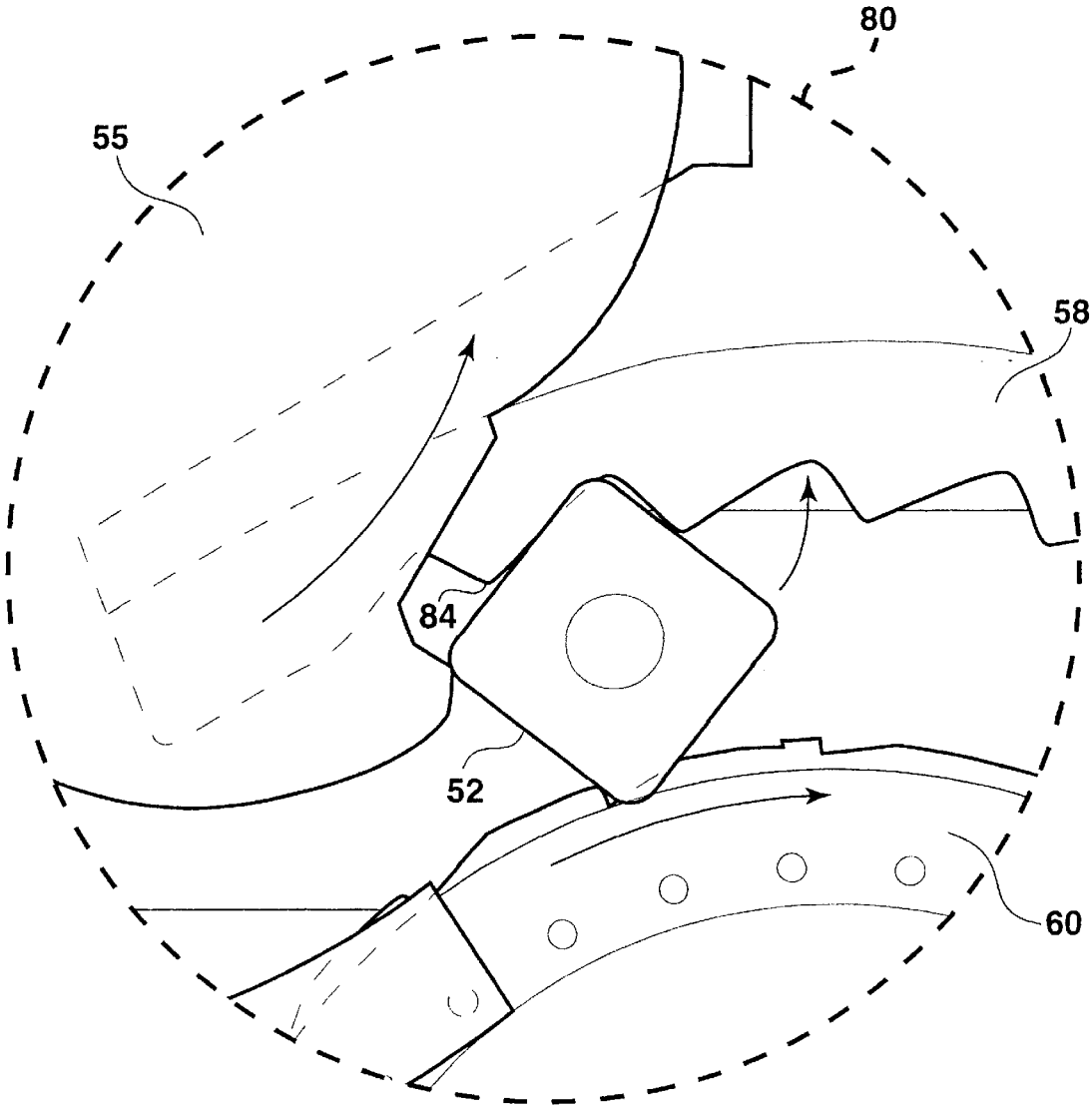

FIGS. 4B–4D show expanded top views of the present invention. In FIG. 4B, the container is being transported to its first position (arrow 86) as the starwheel 55 and drum 60 rotate in the direction of the respective arrows 74, 76. The series of notches 70 can be seen on drum 60 in FIG. 4B.

In FIG. 4C, the resilient peak 84 of the roll on pad 58 pushes against the right side of the center line 88 of container 52. In this fashion, the roll on pad 58 imparts the desired torque on the right side of the center line 88. It has been found that if the peak 84 of the roll on pad 58 is not on the right side of the center line 88 of container 52, there may be no torque generated, or the roll on pad 58 could fight against the desired rotation of container 52. FIG. 4D shows the continued rotation of container 52 within the labeling machine 10. The conveying of a series or plurality of containers such as container 52 results in the desired rotation as described above in conjunction with FIGS. 1–4D.

The foregoing descriptions of specific embodiments of the present invention have been presented for purposes of illustration and description. They are not intended to be exhaustive or to limit the invention to the precise forms disclosed, and it should be understood that many modifications and variations are possible in light of the above teaching. The embodiments were chosen an described in order to best explain the principles of the invention and its practical application, to thereby enable others skilled in the art to best utilize the invention and various embodiments with various modifications as are suited to the particular use contemplated. It is intended that the scope of the invention be define by the Claims appended hereto and their equivalents.

What is claimed is:

1. A labeling machine for applying a label to a non-round article where the article has a series of corners located about its surface, the labeling machine comprising:

a rotatable vacuum drum, the drum including engaging means for rotatably engaging the corners of the non-round articles;

a label associated with the engaging means;

a resilient roll on pad means;

means for rotating the non-round article between the drum and roll on pad means wherein the engaging means engages a first corner to rotate the article between the drum and the pad means, the drum generating a torque which rotates the article as the drum rotates and which compresses the roll on pad means such that the pad means stores compressed energy, and as the article rotates to a position where the first corner is disengaged from the engaging means and a non-corner flat or face portion of the article is against the drum, the roll on pad means imparts the stored energy near or on a second corner of the article which further rotates the article until the engaging mean engages the second corner of the article to continue rotation of the article between the drum and pad means and wherein the label is applied to the surface of the non-round article.

2. A labeling machine for applying a label to a non-round article, the article having a surface defined by an alternating series of corners and faces, the labeling machine comprising:

a drum having a surface with means for disengagedly retaining the label on at least one label application area and for reversibly engaging the article at the application area;

means for applying compression between the drum surface and the corners and faces of the article and continuous torque to the rotation of at least a portion of the article against the at least one application area, the applying means connected to the article.

3. The labeling device of claim 2 wherein the applying means includes means for storing and releasing energy during the rotation between the drum surface and the article surface to create approximately equal torque as the article rotates between the corners and faces.

4. In a labeling machine for applying a label to a non-round article where the article has a series of corners located about its surface, and the labeling machine includes a rotatable vacuum drum, the drum including engaging means for rotatably engaging the corners of the non-round articles, a label associated with the engaging means and a resilient roll on pad means, the method comprising the steps of:

rotating the non-round article between the drum and roll on pad means wherein the engaging means engages a first corner to rotate the article between the drum and the pad means, the drum generating a torque which rotates the article as the drum rotates and which compresses the roll on pad means such that the pad means stores compressed energy, and as the article rotates to a position where the first corner is disengaged from the engaging means and a non-corner portion of the article is against the drum, imparting the stored energy near or on a second corner of the article which further rotates the article until the engaging mean engages the second corner of the article to continue rotation of the article between the drum and pad means and applying the label to a surface of the non-round article.

* * * * *